US006196388B1

(12) United States Patent
Kaposvari

(10) Patent No.: US 6,196,388 B1
(45) Date of Patent: Mar. 6, 2001

(54) CLAMPING MEMBER AND A HOLDER FOR RETAINING ARTICLES

(75) Inventor: Georg Kaposvari, Goirle (NL)

(73) Assignee: Rosti (Incase) B.V., Tilburg (NL)

( * ) Notice: Subject to any disclaimer, the term of this patent is extended or adjusted under 35 U.S.C. 154(b) by 0 days.

(21) Appl. No.: 09/355,755

(22) PCT Filed: Feb. 5, 1998

(86) PCT No.: PCT/NL98/00070

§ 371 Date: Aug. 3, 1999

§ 102(e) Date: Aug. 3, 1999

(87) PCT Pub. No.: WO98/34510

PCT Pub. Date: Aug. 13, 1998

(30) Foreign Application Priority Data

Feb. 5, 1997 (NL) ..... 1005192

(51) Int. Cl.[7] ..... B65D 85/28

(52) U.S. Cl. ..... 206/371; 206/214; 211/69.8; 211/69.9

(58) Field of Search ..... 206/214, 224, 206/371; 211/69, 69.8, 69.9

(56) References Cited

U.S. PATENT DOCUMENTS

| | | | | |
|---|---|---|---|---|
| 1,763,488 | | 6/1930 | Titcomb . | |
| 5,186,320 | * | 2/1993 | Aida | 206/45.19 |
| 5,495,938 | * | 3/1996 | Bedford et al. | 206/45.14 |
| 6,029,816 | * | 2/2000 | Goodwin et al. | 206/371 |

FOREIGN PATENT DOCUMENTS

| | | | |
|---|---|---|---|
| 0 444 746 A1 | 9/1991 | (EP) | B65D/25/10 |
| 870056 | 6/1961 | (GB) . | |
| 9000453 | 9/1991 | (NL) | B65D/25/10 |

* cited by examiner

*Primary Examiner*—David T. Fidei
(74) *Attorney, Agent, or Firm*—Michael D. Bednarek; Shaw Pittman

(57) ABSTRACT

The holder of the present invention comprises at least one clamping member, which is pivotally bearing-mounted in rotation bearings. The clamping member has two clamping arms and an operating portion, in which a resilient lip is formed which presses against a bottom of the holder in order to press this operating portion upwards and the clamping arms downwards. Formed on the bottom of the holder is a wedge-shaped threshold, of which a vertically directed stop face cooperates with the free end of the lip to prevent the clamping member from leaving the rotation bearings in an undesired manner.

15 Claims, 6 Drawing Sheets

CLAMPING MEMBER AND A HOLDER FOR RETAINING ARTICLES

This Application claims priority from PCT Application No. PCT/NL98/00070, filed on Feb. 5, 1998.

BACKGROUND OF THE INVENTION

1. Field of the Invention

The invention relates to a holder comprising at least one clamping member for holding elongated articles such as pens.

2. Description of the Related Art

The known holder has a number of functions. On the one hand, the holder serves to protect the article, while the holder can be arranged in a box-shaped casing for further protection. Together with that box-shaped casing, the holder may then form a gift packing. On the other hand, the holder may serve as a support surface on which the article can for instance be presented in an attractive manner to a potential buyer in a shop.

BRIEF SUMMARY OF THE INVENTION

This holder is useful in particular, but not exclusively, for presenting pens, more in particular a fountain pen, and for that reason, the present invention will hereinafter be described for such practical example. However, is emphasized that the present invention can also be used in connection with other articles.

The known holder is designed to have a number of characteristic features. The clamping members retain a received pen firmly, without damaging that pen. From an aesthetic point of view, the holder has an attractive appearance, in the presence as well as in the absence of a pen. Without requiring modifications, the holder is suitable for receiving pens of different diameters; in particular, pens having a transverse dimension in the range of 6–18 mm can be retained firmly. The holder is suitable for accommodating several pens, but unoccupied seats are not visibly recognizable as such.

In the known holder, this is accomplished in that the holder has a bottom to which a clamping member is pivotally attached, and an elastic and flexible membrane stretched above the clamping member. In a rest condition, i.e. in the absence of a pen, the clamping member is entirely free from the membrane, so that the membrane stretched over this clamping member gives an observer the impression of a support table where no clamping member is present. In a clamping condition, i.e. in the presence of a pen, clamping arms of the clamping member have pivoted upwards, and the flexible membrane is pressed, together with the pen, between those clamping arms.

Although the known holder is highly satisfactory, it is a general object of the present invention to provide an improvement to the known holder.

In the known holder, the flexible membrane is stretched tightly above the clamping members. When a pen is being fitted, the membrane is pressed between the clamping arms of the clamping member, which involves the membrane exerting an upward force on the pen, and the clamping arms, for retaining the pen, exerting a downward force, while the clamping arms of the clamping member are pivoted upwards. For removing a pen, the clamping arms of the clamping member are pulled up first; however, the clamping member resumes its rest position under the influence of the downward tensile force exerted by the membrane, possible aided by gravity. This means that the membrane of the known holder does not only have an aesthetic function, but also a technical function, viz. exerting a force. Hence, for the membrane of the known holder, a material must be used that is elastically stretchable, and the membrane of the known holder must be stretched tightly.

It is an important object of the present invention to provide a holder in which the membrane need not necessarily be stretched tightly, but may for instance be draped in pleats, which has a particular aesthetic effect. It is another important object of the present invention to provide a holder whose membrane need not necessarily be elastically stretchable, so that there is a wider choice of materials for the membrane.

More particularly, it is an object of the present invention to design a clamping member for such holder in such a manner that the clamping action thereof does not depend on the membrane.

According to the present invention, this object is realized in that each clamping member comprises a resilient member which exerts a bias force on the relevant clamping member. Preferably, the clamping member and the resilient member are formed as an integrated unit.

BRIEF DESCRIPTION OF THE DRAWINGS

These and other aspects, characteristics and advantages of the present invention will be clarified by the following description of preferred embodiment of a pen holder according to the invention, with reference to the accompanying drawings, wherein:

FIGS. 3A–B show diagrammatic longitudinal sections of the holder of FIG. 2, FIG. 3A showing the situation where the clamping member is not in use, while FIG. 3B shows the situation where a pen, not shown, is fitted in the clamping member;

DETAILED DESCRIPTION OF THE INVENTION

Figure 1:
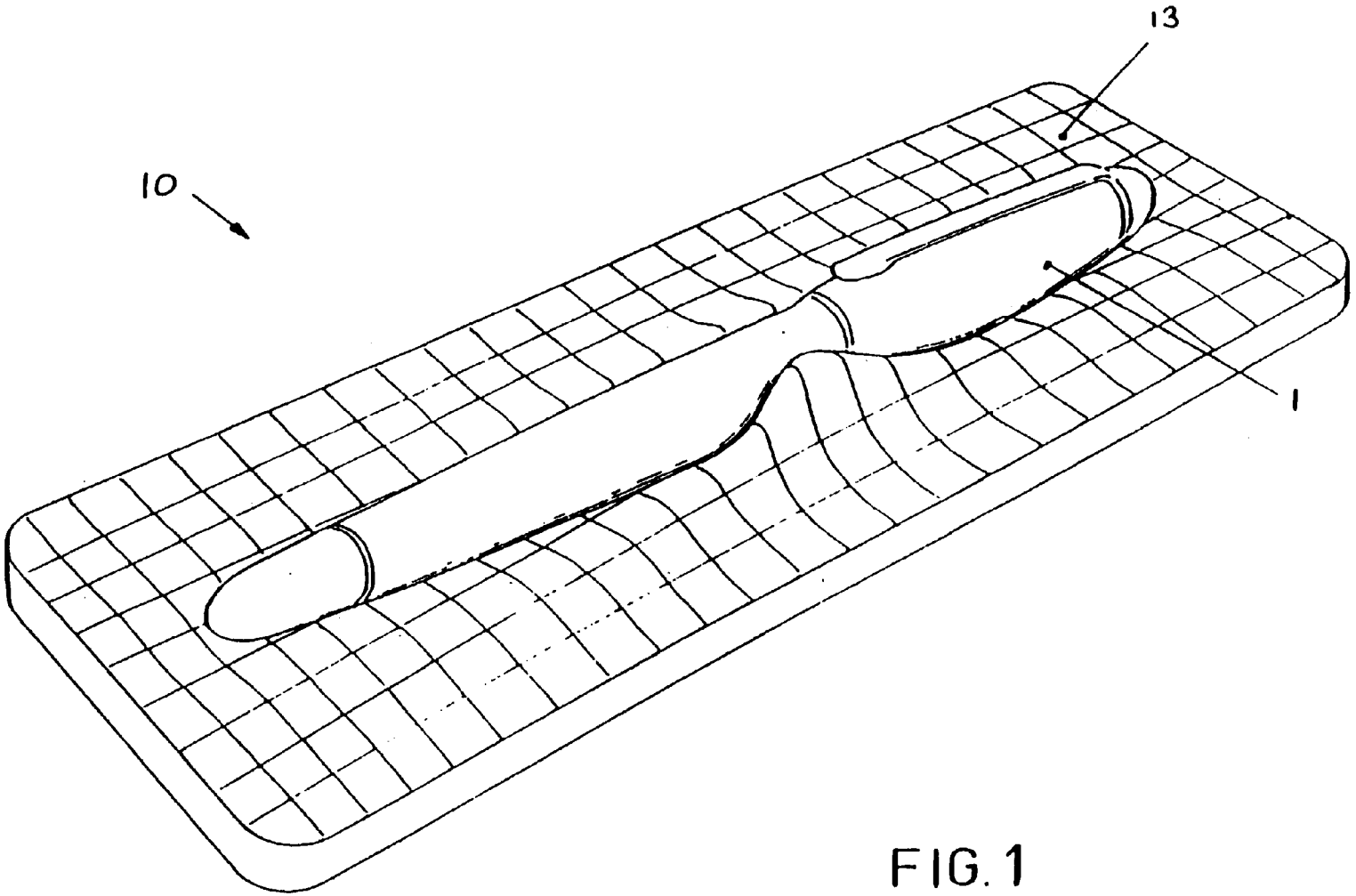
FIG. 1 is a diagrammatic perspective view of a known holder with a pen accommodated therein.

In the Figures, identical reference numerals designate identical or comparable parts. In FIG. 1, the membrane is shown as being provided with a grid, so as to bring out more clearly the form of the membrane deformed by the pen and the clamping member.

Reference numeral 10 generally designates a known holder. The holder 10 is intended to be fitted in a bottom part of a box-shaped casing, which bottom part will have a cover pivotally attached thereto, but this is not illustrated in the Figures. As the holder 10 may be fitted in any casing, and the invention does not reside in the casing, the casing will not be further discussed.

The holder 10 has a bottom 11 and sidewalls 12 extending vertically from the bottom 11. Mounted on the bottom are three clamping members 20. Over the clamping members 20, an elastic and flexible membrane 13 is stretched. If a storage seat is not in use, the relevant clamping member 20 is not visible because of the membrane 13, stretched tightly over the clamping member.

A clamping member 20, preferably manufactured from plastic as an injection-molded product, comprises two clamping arms 21, 22, directed substantially parallel and meeting at a central portion 23. At their free ends, the clamping arms 21, 22 have inwardly directed projections 24, 25, i.e. the projections 24, 25 point towards each other. The central portion 23 is provided with two laterally projecting pivot pins 26 which are in line and, in a normal operating condition, are directed horizontally, i.e. parallel to the bottom 11 of the holder 10. During a pivotal movement about these pivot pins 26, the clamping arms 21, 22 make a vertically directed movement, i.e. substantially perpendicular to the bottom 11 of the holder 10.

Opposite the clamping arms 21, 22, the clamping member 20 comprises an operating portion 27, starting from the central portion 23 and defining, with the clamping arms 21, 22, an angle $\alpha$ with respect to the pivotal axis defined by the pivot pins 26.

If a pen 1 is to be fitted in the holder 10, the pen 1 is positioned above a clamping member 20 and is pressed between the arms 21, 22 of that clamping member 20, with the membrane 13 adjusting itself between the clamping member 20 and the pen 1, around the pen 1, and the pen 1 pressing the operating portion 27 downwards which causes the clamping arms 21, 22 to pivot upwards. In the known holder 20, this involves the membrane being stretched elastically, as a result of which the membrane 13 is tightened around the pen 1 and the lifted clamping arms 21, 22, and exerts an upward force on the pen 1. Accordingly, the pen 1 is drawn against the projections 24, 25 of the clamping arms 21, 22, which projections point towards each other and exert a downward force on the pen 1, aided by the membrane 13 which is stretched tightly over the clamping arms 21, 22 and exerts a downward force on those clamping arms 21, 22.

In this regard, it is observed that each clamping member 20 is intended to receive a pen or another elongate article whose transverse dimension (diameter) lies in a fairly wide range of, for instance, 6–18 mm. For that purpose, the mutual distance between the clamping arms 21, 22 is so large that relatively narrow articles are not clampingly retained by the clamping member 20 in itself: in the known holder 10, such articles are retained by cooperation of the clamping member 20 with the tightened membrane 13.

The present invention provides a holder 10 which is comparable with the known holder but whose clamping members have been improved to be able to tightly retain, completely independently of the presence of a membrane, a pen or another elongated article whose transverse dimension (diameter) lies in the above-mentioned range of, for instance, 6–18mm. This has the advantage that in a holder 10 according to the present invention, the membrane 13 can be replaced by a membrane made from a non-elastically stretchable material, and which is draped with pleats in the holder 10.

Hereinafter, a clamping member improved according to the present invention will be referred to by reference numeral 120.

According to the present invention, the above effects are achieved in that between the operating portion 27 of the clamping member 120 and the bottom 11 of the holder 10, a spring member 130 is arranged which is biased to exert an upward force on the operating portion 27 of the clamping member 120, i.e. a force directed away from the bottom 11. Accordingly, the clamping arms 21, 22 of this clamping member 120 are pressed down by that spring member 130.

Figure 5:
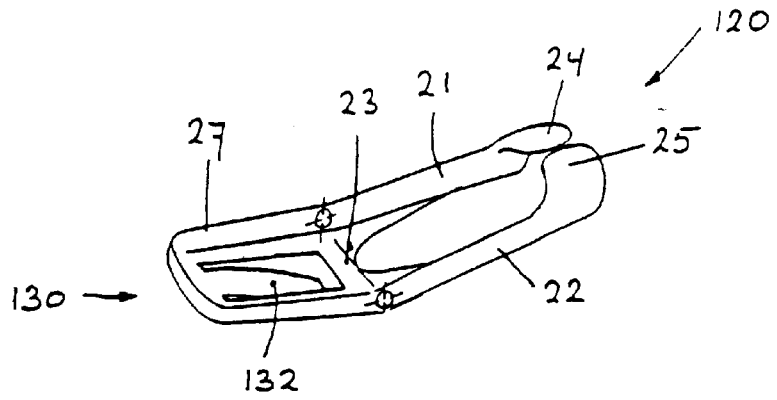
FIG. 5 is a diagrammatic perspective view of a clamping member according to the present invention.
Figure 6:
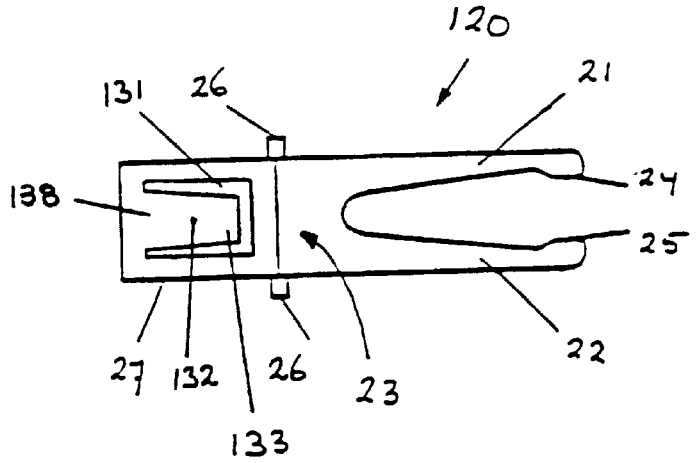
FIG. 6 is a diagrammatic top plan view, comparable with FIG. 4, of the clamping member shown in FIG. 5.
Figure 7:
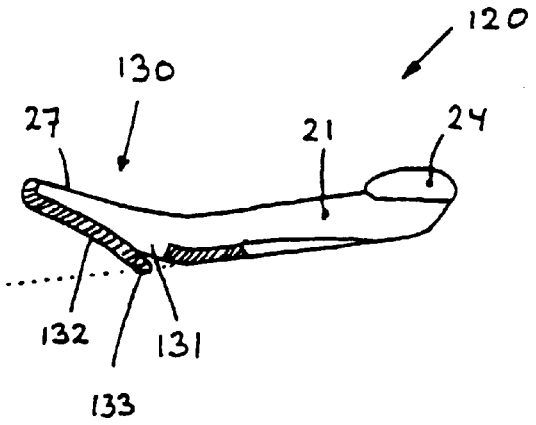
FIG. 7 shows a diagrammatic longitudinal section of the clamping member shown in FIG. 5.

The spring member 130 can be provided in the form of, for instance, a compression spring positioned at the bottom 11 of the holder 10. Preferably, however, the spring member 130 is provided as an integral part of the clamping member 120. This preferred embodiment of that clamping member 120 will hereinafter be discussed with reference to FIGS. 5–7.

The clamping member 120 has clamping arms 21, 22 having clamping projections 24, 25 which point towards each other and can be identical to those of the known clamping member 20. Likewise, the pivot pins 26 can be identical to those of the known clamping member 20.

As far as contour and dimensions are concerned, the operating portion 27 of the clamping member 120 can be identical to the known operating portion 27 of the known clamping member 20, but it is provided with a substantially U-shaped slot 131 defining a lip 132. The bottom of the U-shaped slot 131 is located proximally of the central body portion 23. The ends of the legs of that U-shaped slot 131 define, between one another, a base 138 of the lip 132. The lip 132 is bent, the concave side of the lip 132 being at the bottom side of the operating portion 27. Preferably, and as clearly illustrated in FIG. 7, the free end 133 of the lip 132 extends below the extension (shown in a dotted line) of the bottom side of the clamping arms 21, 22.

Figure 2:
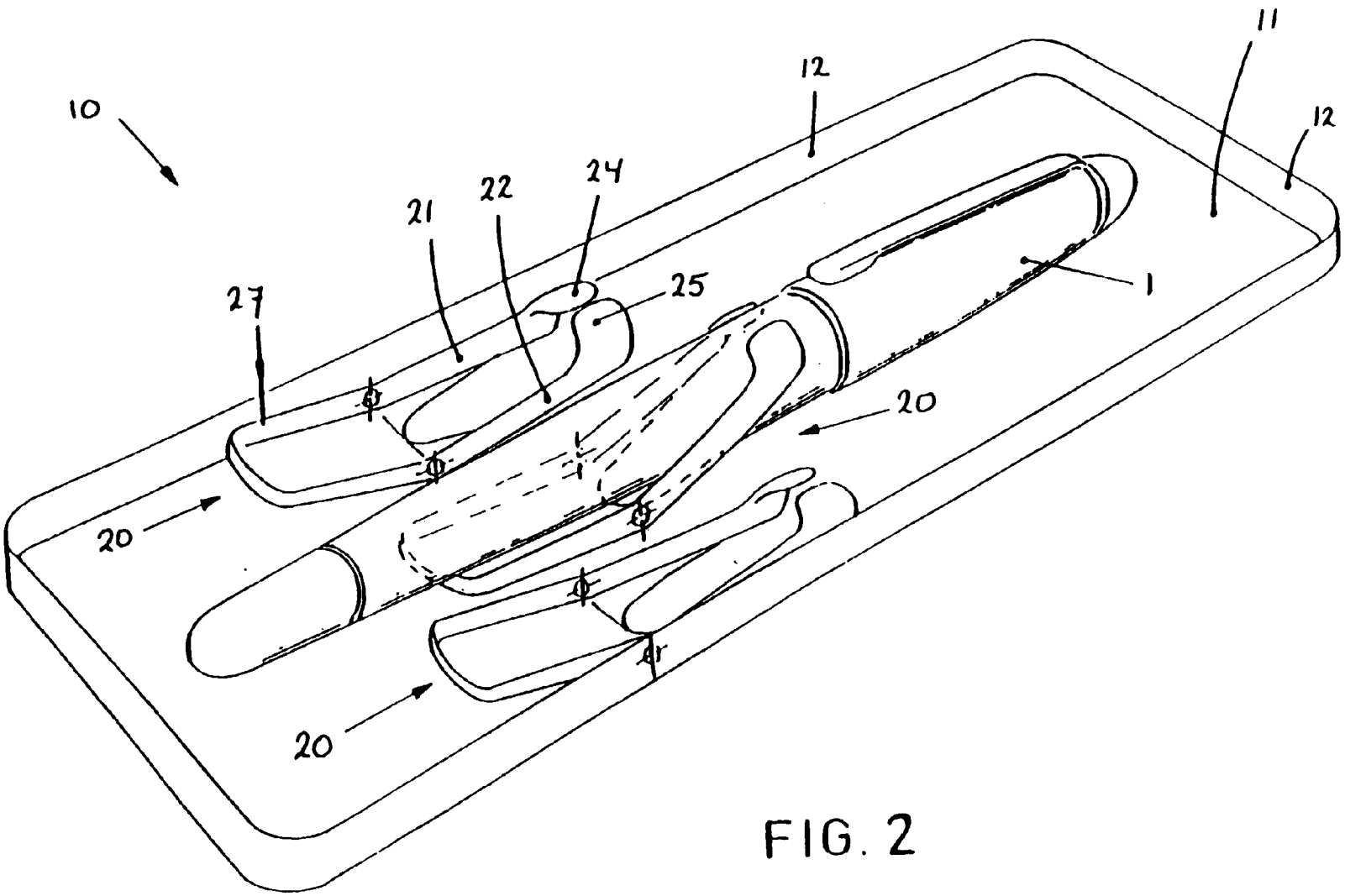
FIG. 2 is a perspective view comparable with FIG. 1, with the membrane removed therefrom.

The clamping member 120 according to the present invention can be mounted in the known holder 10 as replacement of the known clamping member 20, without requiring any modifications of the bottom 11. Hence, the operation of the inventive clamping member 120 will hereinbelow be discussed with reference to FIGS. 2, 3A–B and 5–7, while in respect of FIGS. 2 and 3A–B, it is assumed that the clamping members 20 have been replaced by the clamping members 120. Because, as will be clarified, the clamping action of a clamping member 120 according to the present invention does not depend on cooperation with a membrane, in the following discussion it will be assumed that the membrane 13 has been entirely removed. However, it is observed that from an aesthetic point of view, a membrane will in practice always be present, but that a membrane, although not necessary for the clamping action, does not adversely affect the intrinsic clamping action of the inventive clamping member 120.

Figure 3A:
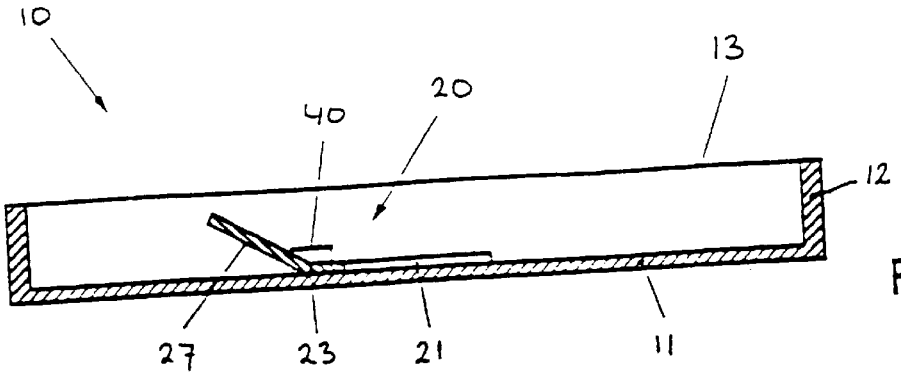
Figure 3B:
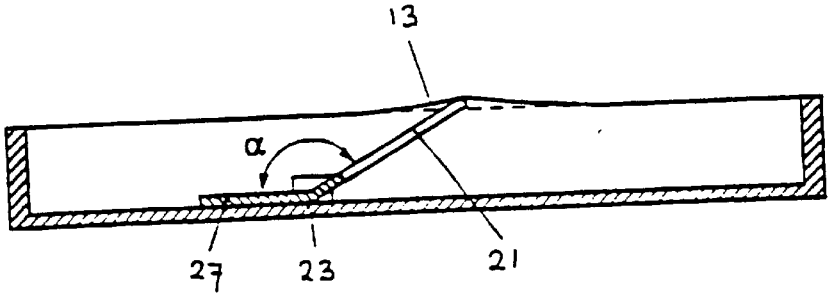
Figure 4:
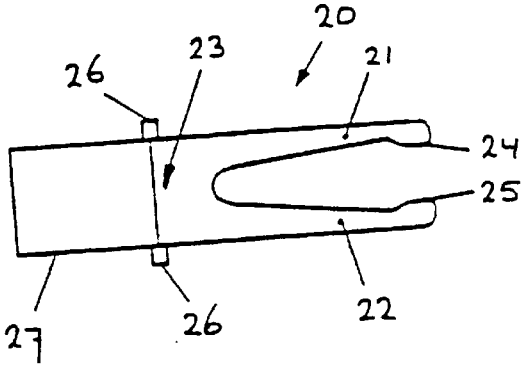
FIG. 4 is a diagrammatic top plan view of a known clamping member.

In the absence of a pen, the clamping member 120 is in the rest condition which is illustrated in FIG. 3A for the known clamping member 20. In that condition, the clamping arms 21, 22 are in contact with the bottom 11. The free end 133 of the lip 132 is also in contact with the bottom 11, while the lip 132 is slightly compressed, so that the lip 132 presses the operating portion 27 upwards, as a result of which the clamping arms 21, 22 are pressed downwards, against the bottom 11.

When a pen 1 is inserted into the clamping member 120, that pen 1 presses on the free end of the operating portion 27, whereby that operating portion 27 is pressed downwards and the clamping arms 21, 22 pivot upwards, against the spring force of the lip 132, until the pen 1 snaps underneath the projections 24, 25 of the clamping arms 21, 22. The pen 1 can then be released. In comparison with the rest condition outlined in FIG. 3A, the clamping member 120 has then pivoted about its pivot pins 26, anti-clockwise in FIG. 3A, with the resilient lip 132 pressing against the bottom 11 and pressing the operating portion 27 upwards. Hence, that operating portion 27 exerts an upward force on the pen 1, while the projection 24, 25 of the clamping arms 21, 22 exert a downward force on the pen 1. Hence, the clamping member 120 tends to rotate together with the pen 1 in the direction as determined by the resilience of the lip 132, i.e. clockwise in the Figures, while the right-hand end of the pen is pulled against the bottom 11.

In this manner, the pen 1 is retained by the clamping action of three forces, viz. a first, upward force exerted by the operating portion 27; a second, downward force exerted by the projections 24, 25 of the clamping arms 21, 22; and a third, upward reactive force exerted by the bottom 11 of the holder 10.

Figure 8A:
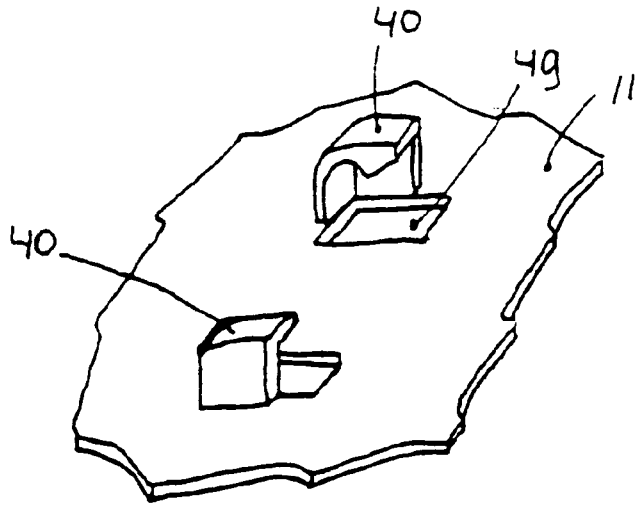
FIG. 8A is a diagrammatic perspective view of a bottom portion of a holder having a known rotation bearing.
Figure 8B:
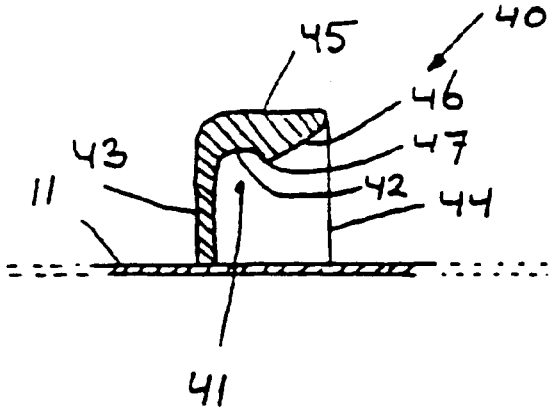
FIG. 8B shows a diagrammatic longitudinal section of a known rotation bearing.

The pivot pins 26 of the clamping member 120 are each bearing-mounted in a rotation bearing 40 which is mounted on the bottom 11 of the holder 10 and is preferably formed integrally therewith. FIG. 8A is a perspective view of a rotation bearing 40 known from the above-mentioned publication, and FIG. 8B shows an enlarged section thereof. FIG. 8A shows that the rotation bearing 40 adjoins an opening 49 formed in the bottom 11. This opening 49 has to do with the preferred manufacturing process of the holder 11, in which the bottom 11 and the rotation bearings 40 are manufactured in a single pass by means of injection molding, and has no further function.

The known rotation bearing 40 comprises a chamber 41 for accommodating a pivot pin 26. As the pivot pin 26 will generally have a round section, and the rotation axis thereof is directed horizontally, the chamber 41 has a top wall 42 having a round contour corresponding to the round contour of a pivot pin 26. More in particular, the chamber 41 is bounded by a rear wall 43 extending upwards from the bottom 11, a sidewall 44 extending upwards from the bottom 11, and a top wall 45, the top wall 45 comprising the round top wall portion 42 of the chamber 41 as well as a diverging top wall portion 46 which blends with the round top wall portion 42 of the chamber 41 via a substantially V-shaped top wall portion 47. The vertical distance between that V-shaped top wall portion 47 and the bottom 11 is less than the vertical dimension of the chamber 41. When a clamping member 120 is fitted, the pivot pin 26 makes a horizontally directed, linear movement perpendicularly to its rotation axis, while the pivot pin 26 passes, via the diverging top wall portion 46, the V-shaped top wall portion 47 to enter the chamber 41. This linear movement will be referred to by the term "insertion movement" and is directed leftwards in FIG. 8.

In this manner, the pivot pin 26 in the chamber 41 forms a snap connection for pivotally connecting the clamping member 120 to the bottom 11.

Figure 9:
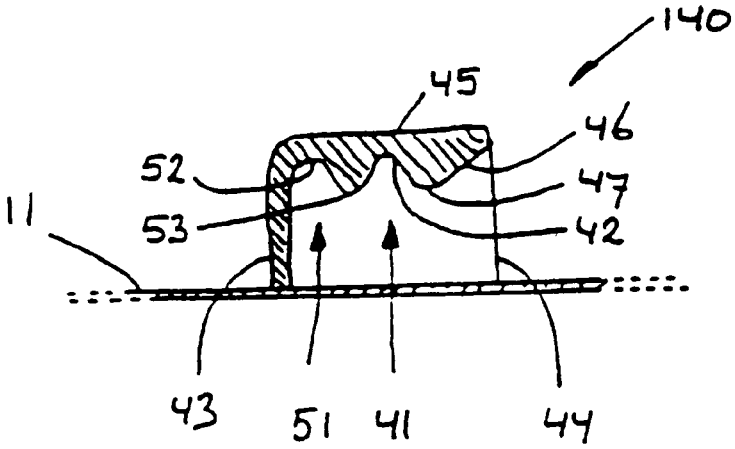
FIG. 9 shows a diagrammatic section, comparable with FIG. 8B, of a preferred construction of a rotation bearing according to the present invention for the clamping member shown in FIG. 5.

Conventionally, the pen 1 in the holder 10 is retained in a "straight" manner, by which is meant that the longitudinal direction of the retained pen 1 is substantially parallel to a sidewall 12 of the holder 10. However, there is a need for a holder which is capable of retaining a pen "obliquely", by which is meant that the pen in the holder will be directed substantially diagonally. More in particular, the object of the present invention is to provide a construction for the holder 10 in which that holder 10 is capable of retaining a pen 1 either "straight" or "obliquely", as desired. As illustrated in FIG. 9, to this end, the holder 10 according to the present invention has at least one rotation bearing 140 which comprises, behind the chamber 41 already mentioned, a second chamber 51 having a top wall 52 with a round contour, the first chamber 41 and the second chamber 51 being separated by a second top wall portion 53 whose contour may be substantially V-shaped or rounded, in which case the combination of the top wall portions 42, 53, 52 may have a sinusoidal wave form, as illustrated in FIG. 9. The pivot pin 26 can be introduced into the second chamber 51 by inserting the pivot pin 26 into the first chamber 41 in the conventional manner, and, subsequently, pressing the pivot pin 26 from the first chamber 41 through to the second chamber 51, beyond the second top wall portion 53.

It will be understood that if the pen 1 is retained substantially "straight" by the clamping member 120 when the pivot pin 26 is located in the first chamber 41 of the rotation bearing 140, the pen 1 is retained substantially "obliquely" by the clamping member 120 when the pivot pin 26 is located in the second chamber 51 of the rotation bearing 140.

In the known holder 10, the dimensioning of the rotation bearing 40 is chosen so that the pivot pin 26 precisely runs clear of the top wall 42 of the chamber 41: if the vertical dimension of the chamber 41 were too great, the pivot pins 26 would have much play and the clamping member 20 would "rattle" in the rotation bearing 40, whereas if the vertical dimension of the chamber 41 were too small, the clamping member 20 would be clampingly retained between the bottom 11 of the holder 10 and the top wall 42 of the chamber 41.

Further, the vertical distance between the lowest point of the V-shaped top wall portion 47 and the bottom 11 is less than the vertical distance between the bottom 11 and the top edge of the pivot pin 26: during insertion of the pivot pin 26 into the chamber 41, a slight elastic deformation of the pivot pin 26 and/or the V-shaped top wall portion 47 takes place. However, if this vertical distance between the lowest point of the V-shaped top wall portion 47 and the bottom 11 is too large, the pivot pin 26 is not retained with sufficient certainty by the rotation bearing 40, whereas, if this vertical distance between the lowest point of the V-shaped top wall portion 47 and the bottom 11 is too small, the force needed for inserting the pivot pin 26 into the chamber 41 is fairly great, while the risk of plastic deformation or even the occurrence of tearing becomes greater. The above implies that the tolerance for manufacturing the rotation bearing 40 is slight.

In practice, it could happen that a clamping member, together with the pen retained thereby, slips from the rotation bearing if a shock directed in the longitudinal direction of the pen is applied to the holder, for instance by falling. Hence, it is an object of the invention to provide a holder which is better resistant to shocks. More in particular, it is an object of the present invention to provide a holder in respect of which the tolerance requirements have eased, while a clamping member is firmly retained in the rotation bearings with great certainty and without rattling.

As the clamping member 120 according to the present invention comprises a resilient lip 132, which lip 132 provides that an upward force is exerted on the clamping member 120 relative to the bottom 11, the pivot pin 26 is pressed against the top wall 42 of the chamber 41. This implies that the vertical distance between the top wall 42 of the chamber 41 and the bottom edge of the V-shaped top wall portion 47 may be given greater dimensions. A linear movement of the pivot pin 26 in a direction opposite the insertion direction, which would involve the pivot pin 26 leaving the chamber 41, is then opposed with great certainty by the contour of the top wall 42 of the chamber 41, which contour may be directed substantially vertically adjacent the V-shaped top wall portion 47.

Figure 10:
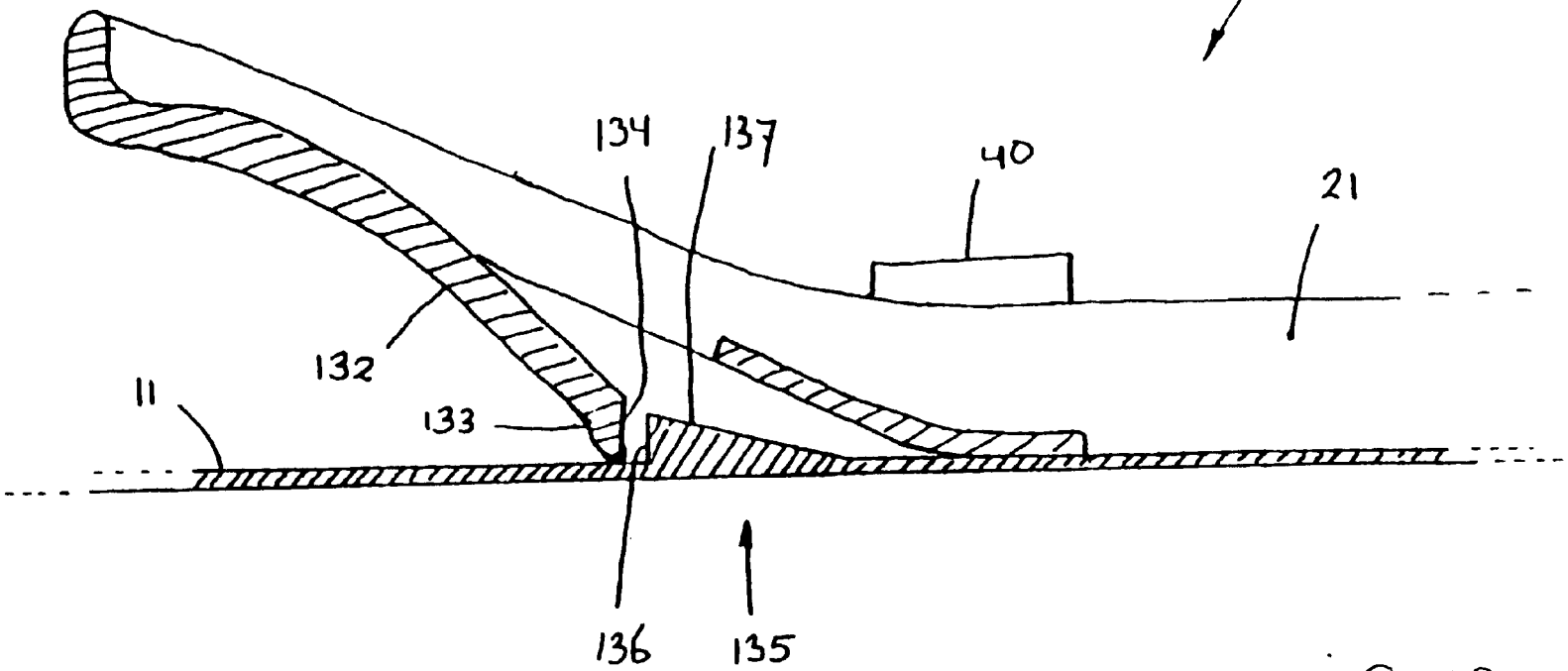
FIG. 10 shows an enlarged longitudinal section of a clamping member and a bottom portion to illustrate a locking.

In a preferred embodiment, the invention even provides a positive locking, as illustrated in FIG. 10. In FIG. 10, a threshold 135 is provided on the bottom 11, which threshold, as illustrated, can have a wedge-shaped longitudinal section with a substantially vertically directed stop face 136 and an inclined run-on face 137. Alternatively, the stop face 136 could be provided by arranging a recess in the bottom 11.

The stop face 136 is directed according to the insertion direction of the chamber 41 of the rotation bearing 40, and is so positioned that when the pivot pins 26 of the clamping member 120 have been inserted into the chamber 41 while the clamping arms 21, 22 point against the insertion direction, the free end 133 of the resilient lip 132 is located precisely before this stop face 136, with a slight mutual distance which is sufficient for allowing a pivotal movement of the clamping member 120 for receiving a pen.

During the assembly of the clamping member 120 to the bottom 11 of the holder 10, the free end 133 of the lip 132 passes the run-on face 137, with the lip 132 being slightly depressed, until that end 133 snaps behind the threshold 135 and is positioned opposite the stop face 136. If a force in opposite direction were then exerted on the clamping member 120, the free end 133 of the lip 132 would strike the stop face 136, whereby a displacement of the clamping member 120 in a direction opposite to the insertion direction is prevented with certainty.

In this connection, it is preferred that the free end 133 of the lip 132 have an end face 134 which, in the rest condition, is directed substantially vertically, for a certain cooperation with the stop face 136.

It will be readily understood by anyone skilled in the art that the protective scope of the present invention as defined by the claims is not limited to the embodiments shown in the drawings and discussed, but that it is possible to change or modify the embodiments shown of the holder according to the invention within the framework of the inventive concept.

Although the invention is eminently suitable for use in a holder that is intended for accommodating elongated articles such as pens, it will be clear that the invention can also be used in a holder for accommodating articles of a different type, such as for instance medical instruments, jewelry, and the like, where a clamping member to be used is adapted to the shape of the article in question.

Further, the number of clamping members in a holder may be unequal to three.

What is claimed is:

1. A clamping member for use in a holder for retaining articles, said clamping member comprising:

(a) a central body portion;

(b) two clamping arms extending from said central body portion;

(c) two pivot pins projecting laterally from said central body portion; and (d) an operating portion extending from said central body portion and opposite said clamping arms, wherein said operating portion comprises a U-shaped slot and a lip, wherein said lip is bent to a bottom side of said operating portion;

wherein said lip comprises a spring member integral with said clamping member;

wherein said pivot pins of said clamping member are pivotally attached to a bottom of said holder; and wherein said lip exerts a force causing said clamping member to pivot about said pivot pins.

2. The clamping member according to claim 1, wherein said lip has a free end, and wherein said free end extends beyond a bottom side of the clamping arms.

3. The clamping member according to claim 1, wherein said lip has a free end, and wherein said free end has a substantially vertically directed end face.

4. A holder for retaining articles comprising:

(a) a clamping member that comprises:

(i) a central body portion;

(ii) two clamping arms extending from said central body portion;

(iii) two pivot pins projecting laterally from said central body portion; and (iv) an operating portion extending from said central body portion and opposite said clamping arms, wherein said operating portion comprises a U-shaped slot and a lip;

wherein said lip is bent to a bottom side of said operating portion;

wherein said lip comprises a spring member integral with the clamping member;

wherein said pivot pins of said clamping member are pivotally attached to a bottom of said holder; and wherein said lip exerts a force causing said clamping member to pivot about said pivot pins;

(b) a bottom; and (c) two rotation bearings formed on said bottom for receiving the pivot pins of the clamping member, wherein said bottom comprises a stop face directed perpendicularly to said bottom and being arranged for cooperating with the free end of the clamping member to oppose the removal of the clamping member from said rotation bearings.

5. The holder according to claim 4, wherein said stop face is defined by a threshold formed on the bottom.

6. The holder according to claim 5, wherein said threshold has a wedge-shaped longitudinal section and comprises an inclined run-on face.

7. The holder according to claim 4, wherein at least one of said rotation bearings has at least two chambers disposed one behind the other, for receiving one of the pivot pins of the clamping member.

8. The holder according to claim 4, wherein said lip has a free end, and wherein said free end extends beyond a bottom side of the clamping arms.

9. The holder according to claim 8, wherein said stop face is defined by a threshold formed on the bottom.

10. The holder according to claim 9, wherein said threshold has a wedge-shaped longitudinal section and comprises an inclined run-on face.

11. The holder according to claim 8, wherein at least one of said rotation bearings has at least two chambers disposed one behind the other, for receiving one of the pivot pins of the clamping member.

12. The holder according to claim 4, wherein said lip has a free end, and wherein said free end has a substantially vertically directed end face.

13. The holder according to claim 12, wherein said stop face is defined by a threshold formed on the bottom.

14. The holder according to claim 13, wherein said threshold has a wedge-shaped longitudinal section and comprises an inclined run-on face.

15. The holder according to claim 12, wherein at least one of said rotation bearings has at least two chambers disposed one behind the other, for receiving one of the pivot pins of the clamping member.

* * * * *